United States Patent [19]

Delbuck

[11] Patent Number: 4,590,332

[45] Date of Patent: May 20, 1986

[54] PHASE COHERENT LOW FREQUENCY SPEAKER

[76] Inventor: Pascal Delbuck, 31220 La Baya #110, Westlake Village, Calif. 91362

[21] Appl. No.: 653,781

[22] Filed: Sep. 24, 1984

Related U.S. Application Data

[63] Continuation-in-part of Ser. No. 496,957, May 23, 1983, abandoned.

[51] Int. Cl.[4] ..... H04R 1/24; H04R 9/04; H04R 9/06

[52] U.S. Cl. ..... 179/115.5 PS; 179/115.5 R; 179/115.5 ES; 179/115.5 PC; 179/115.5 VC; 179/146 E; 381/88

[58] Field of Search ..... 179/115.5 PS, 115.5 R, 179/115.5 ES, 115.5 PC, 115.5 VC, 117, 119 R, 146 E, 181 R, 181 W; 381/87, 88

[56] References Cited

U.S. PATENT DOCUMENTS

| | | | |
|---|---|---|---|
| 3,150,441 | 9/1964 | Kloss | 179/115.5 R |
| 4,061,890 | 12/1977 | Froeschle | 179/115.5 VC |
| 4,158,756 | 6/1979 | Keezer | 179/115.5 R |
| 4,443,667 | 4/1984 | Hunt | 179/117 |
| 4,465,905 | 8/1984 | Nation | 179/115.5 R |

FOREIGN PATENT DOCUMENTS

| | | | |
|---|---|---|---|
| 2604888 | 8/1976 | Fed. Rep. of Germany | 381/87 |
| 2063618 | 6/1981 | United Kingdom | 179/115.5 PS |

*Primary Examiner*—Gene Z. Rubinson
*Assistant Examiner*—Danita R. Byrd
*Attorney, Agent, or Firm*—Erik M. Arnhem

[57] ABSTRACT

A phase coherent low frequency dynamic woofer type loud speaker has a shallow depth convex cone diaphragm peripherally secured to a loud speaker support frame at one face. A ring permanent magnet is disposed behind the convex cone encircling a concentrically disposed smaller diameter pole piece. A tubular voice coil is centrally secured to the internal face of the vibrating cone and is disposed in the annular free channel volume space between the concentric circular pole piece and the inner circular volume of the permanent magnet. A flat back plate adaptively is secured to the pole piece and the permanent magnet in a concentric array. The back plate, pole piece, ring magnet and top plate form a magnet assembly which in one embodiment is removable as a unit from the speaker support. Multiple structural frame supports having a triangular cross-section extend radially connectively to the exterior loud speaker mounting frame. Also shown is a compatible tunable acoustic resonator having a domed diaphragm structure similar to that of the speaker coupled to a tunable length resonant tube.

23 Claims, 30 Drawing Figures

FIG.3
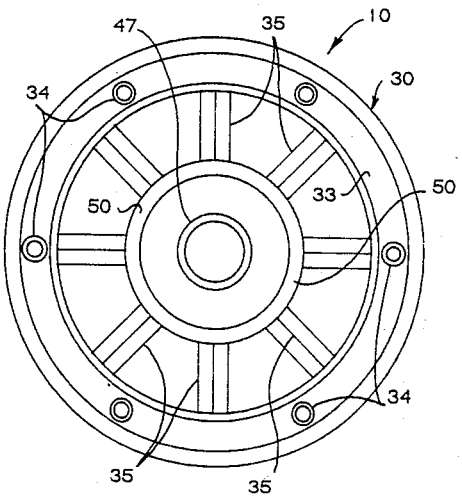
FIG.4
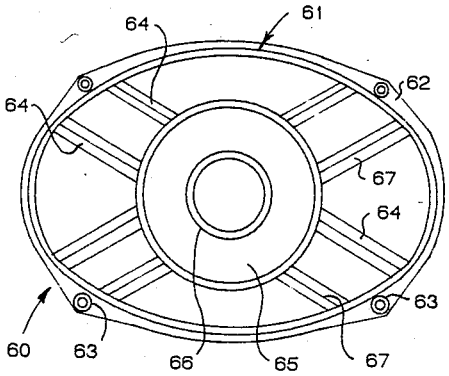
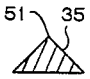
FIG.3A
FIG.6
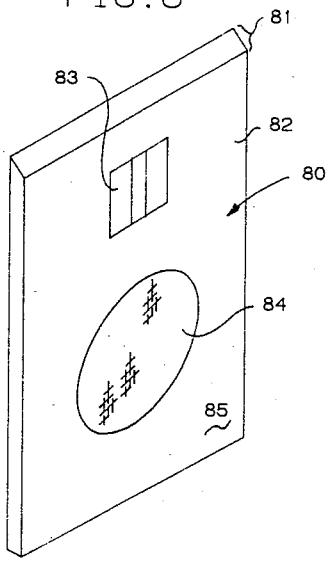
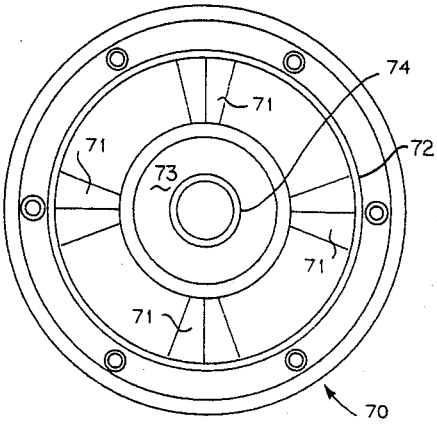
FIG.5

PHASE COHERENT LOW FREQUENCY SPEAKER

CROSS-REFERENCE TO PARENT APPLICATION

This application is a continuation-in-part application of parent application Ser. No. 496,957 filed May 23, 1983, now abandoned.

BACKGROUND OF THE INVENTION

The phase coherent low frequency loud speaker of this invention is classified in Class 179, subclasses 181R, 181F, 115.5R and 115.5ME.

Bertagni, in U.S. Pat. No. 3,722,617 issued Mar. 27, 1973, discloses a flat diaphragm for sound transducers having a flat front face and rear face, defining a central figure portion connected to an electromagnetic assembly and surrounded by a marginal vibration damping portion of larger thickness than the adjacent peripheral zone of the figure portion.

Bertagni, in U.S. Pat. No. 3,767,005 issued Oct. 23, 1973, discloses a flat loud speaker diaphragm with means for enhancing the low frequencies wherein the diaphragm has a marginal vibration damping portion surrounding a sound producing figure portion and at least a portion of said marginal vibration damping portion is connected to a plate-like member adapted to vibrate only in the low frequency range.

Allison, in U.S. Pat. No. 4,029,910 issued June 14, 1977, discloses an audio loud speaker comprising a diaphragm which is rotationally symmetrical about a central axis, the diaphragm including a sound propagating surface extending between a larger circular edge and a small circular edge spaced apart therefrom along the axis in the direction of sound propagation. The voice coil frame is secured to the diaphragm adjacent the smaller edge, the larger circular diaphragm edge is fixed relative to the magnetic structure (e.g. to the mounting panel).

In U.S. Pat. No. 4,317,965 issued Mar. 2, 1982, Toyoda discloses a dynamic loud speaker formed with a vibration plate disposed between a yoke and a permanent magnet. The vibration plate is substantially planar with a central projecting cylindrical region. A voice coil is disposed on the vertical wall of the central projecting region of the vibration plate.

In U.S. Pat. No. 3,955,055 issued May 4, 1976, Kawakomi et al, disclose a dynamic loud speaker including a dome type diaphragm having at least one convex surface and another concave surface, contiguous with the convex surface. Specifically, the concave surface is annular portion surrounding the convex surface.

SUMMARY OF THE INVENTION

An improved loudspeaker comprises a rigid substantially planar support member having an interior hub portion, an annular frame portion spaced apart from the hub portion, and a plurality of radially extending spokes coupling the hub portion and the annular frame portion, the hub portion further defines a center aperture and a concentric recess, and a magnetic assembly having a cylindrical central pole piece having an outer diameter smaller than that of the center aperture, and an annular ring magnet concentrically disposed about a portion of the pole piece having an inner diameter greater than the outer diameter of the pole piece; and a volume chamber formed by the space between the pole piece and the ring magnet; and a voice coil assembly having a cylindrical insulative tube and a plurality of conductive electric windings wound upon the insulative tube; and a generally dome-shaped diagphragm having a convex exterior surface and a concave interior surface; and means attaching the voice coil insulative tube to the concave interior surface of the diaphragm; and means resiliently supporting the diaphragm from the annular frame portion of the support member such that the convex exterior surface faces outwardly from the support member and the voice coil assembly extends into the volume chamber.

Included in the objects of this invention are:

To provide a thin low frequency audio phase coherent speaker, as measured fromt the back plate securing the permanent magnet and the pole piece to the exterior of a convex cone diaphragm.

To provide an improved low frequency audio speaker having less audio distortion than conventional low frequency audio speakers.

To provide a low manufacturing cost audio speaker, as compared to conventional audio speakers having basket structure.

To provide a more limited audio distortion in a convex cone diaphragm.

To provide a speaker structural frame producing less distortion due to reflected audio waves.

To provide an improved low frequency phase coherent speaker which can be secured in the same plane of a loudspeaker enclosure with higher frequency speakers, with resulting less audio distortion.

Other objects and advantages of this invention are taught in the following description and claims.

BRIEF DESCRIPTION OF THE DRAWINGS

The description of this invention is to be read in conjunction with the following drawings:

FIG. 3 is a planar front cross sectional view through 3—3 of FIG. 2A, illustrating an improved low frequency speaker having improved audio coherence.

FIG. 3A illustrates the triangular cross sectional view of a radial spoke of FIG. 3.

FIG. 4 is another planar front cross sectional view through an improved low frequency speaker having improved audio phase coherence, the speaker formed an elliptical frontal geometry.

FIG. 5 is still another planar front cross sectional view as in 3—3 of FIG. 2A, through an improved low frequency speaker having improved audio phase coherence, and few radial spokes of triangular cross section.

FIG. 6 is a projection view of an improved audio thin loudspeaker enclosure having a high frequency and a low frequency speaker of improved audio phase coherence. Both speakers are secured in a single plane with minimum audio distortion, and are suitable for mounting the enclosure in an automobile door, or in other thin enclosure space.

FIG. 14AA is an assembly view of the embodiment of the present invention shown in FIG. 14A.

FIG. 14BB is an assembly view of the embodiment of the present invention shown in FIG. 14B.

DESCRIPTION OF THE PREFERRED EMBODIMENT OF THE INVENTION

Figures 1A, 1B:
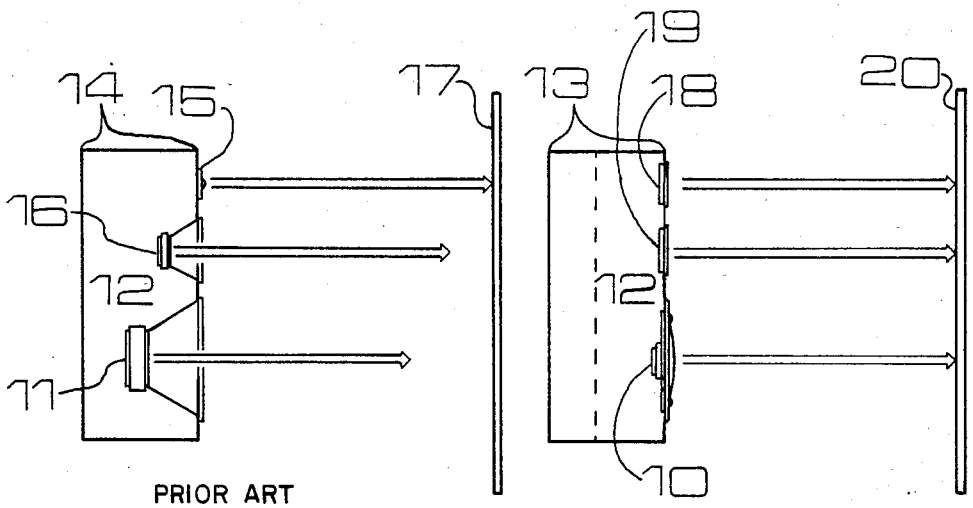
PRIOR ART FIG. 1A
FIG. 1A is a cross sectional view through a conventional audio loudspeaker enclosure having a low frequency, a mid frequency and a high frequency speaker in non-planar positions and conventional audio quality.
FIG. 1B is a cross sectional view through the improved audio loudspeaker enclosure of this invention, illustrating the planar position of the low frequency, mid-frequency, and the high frequency speakers providing improved audio emission quality with less audio distortion.

A thin depth phase coherent low frequency loud speaker 10 of the woofer type is illustrated in FIG. 1B, illustrating its substantially thinner depth than is achieved by a conventional low frequency loudspeaker 11 of FIG. 1A. As can be seen, the depth 13 of enclosure 12 of FIG. 1B can be reduced as compared to enclosure 12′ of FIG. 1A. This is made possible by the reduced depth of speaker 10. The construction of FIG. 1A illustrates the phase differences of audio vibrations from the several conventional audio loud speakers, as high frequency speaker 15, mid frequency speaker 16, and conventional low frequency speaker 11 reach the listener at 17 at different time intervals, providing audio distortion.

The construation of the FIG. 1B illustrates phase coherence of the several loud speakers, high frequency speaker 18, mid frequency speaker 19, and low frequency 10 disposed and secured in a planar arrangement of the vibrational diaphragms of the speakers 18, 19 and 10, so as to provide less distortion of the sound waves emitted by each speaker, as heard by the listener at 20. By installing the voice coils of speakers 18, 19 and 10 in the same plane, all the speakers are in sound phase and the sound waves reach the listener at the same time at 20.

Figure 2A:
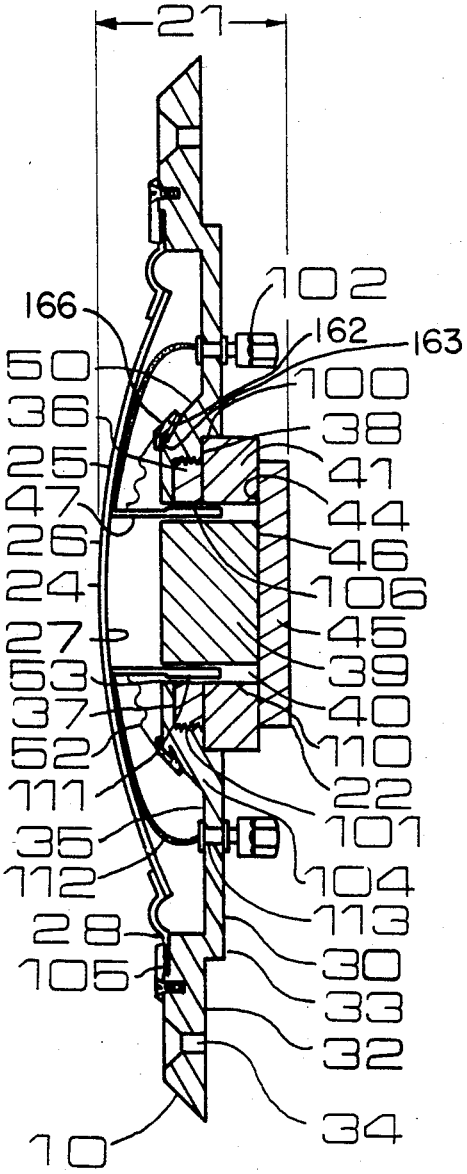
FIGS. 2A and 2B are cross sectional views through similar embodiments of thin improved low audio frequency speakers having improved phase coherence.
Figure 2B:
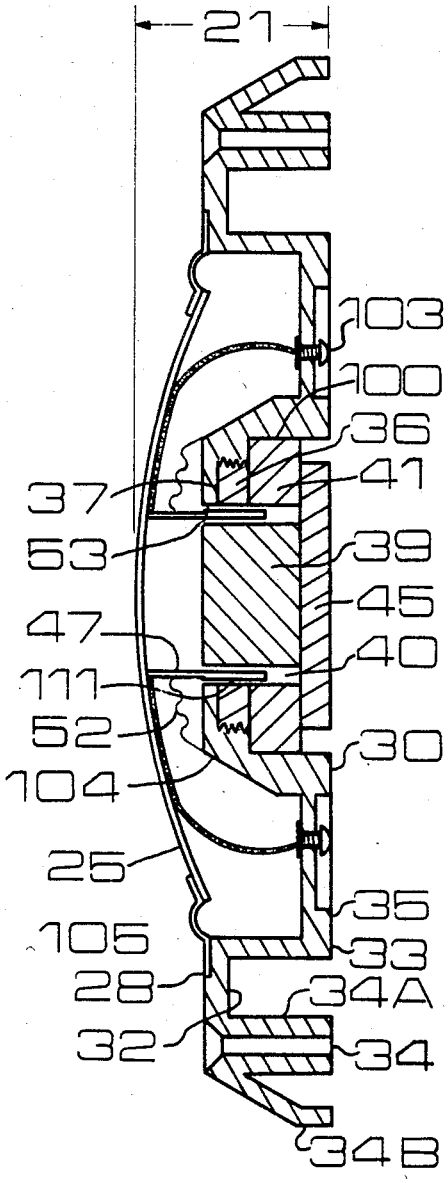

DESCRIPTION OF FIGS. 2A and 2B

FIG. 2A sets forth a cross-section view of the present invention speaker generally referenced by numeral 10 having a generally planar support 30 comprising a center hub 104 which defines a central aperture 53 a circular recess 37 and a circular recess 100. Central aperture 53 and circular recesses 37 and 38 are all concentric for reasons set forth below in greater detail. A plurality of spokes 35 extend radially outwardly from the perimeter of hub 104 and support an annular mounting frame 33 which in turn defines an interior face 32 and a diaphragm recess 105. Mounting frame 33 further defines a plurality of mounting holes 34 equally spaced about the perimeter thereof. A generally dome-shaped diaphragm 25 defines a first face 26 a second face 27 and an exterior apex 24 at its center. A diaphragm periphery 28 comprising a generally annular resilient member is bonded to the perimeter of diaphragm 25 along first face 26 thereof and to diaphgragm recess 105 of support 30. Diaphragm 25 is supported by diaphragm periphery 28 in a resilient manner permitting diaphragm 25 to move laterally (that is toward or away from hub 104) to produce acoustic energy. A generally tubular voice coil 47 is attached to second face 27 of diaphragm 25 and is concentrically disposed with respect to said diaphragm and extends through central aperture 53 of hub 104. An annular top plate 36 having a plurality of external threads 101 about its perimeter is received by circular recess 37 and maintained therein by the cooperation of threads 101. A ring magnet 41 having generally annular construction is received by circular recess 100 in hub 104. A generally annular backplate 45 having a face 46 is bonded to ring magnet 41 at face 44 thereof. Top plate 36 defines a central apertures 106 while ring magnet 41 defines a central aperture 110. A pole piece 39 comprises a generally cylindrical member, formed of a magnetic metal such as iron, which is concentrically received with respect to apertures 53, 106, and 110. The space between apertures 53, 106 and 110 and the exterior of pole piece 39 and face 46 of backplate 45 defines a channel volume 40 which receives a portion of voice coil 47. In accordance with well-known speaker fabrication techniques, voice coil 47 accommodates a plurality of electrically conductive windings 111 which terminate in voice coil wires 112.

Support 30 receives a pair of binding posts 102 which extend through aperture 113 in support 30 and receive the end portions of voice coil wires 112.

In operation, an alternating electrical signal is coupled to winding 111 by binding posts 102 and wires 112 and produces a correspondingly varying magnetic flux in the region surrounding winding 111. By well known electromagnetic principles, the flux variations around winding 111 interact with pole piece 39 to create forces between winding 111 and pole piece 39 which because of the greater mass and rigid mounting of the pole piece, cause axial forces to be exerted against voice coil 47. Because voice coil 47 is free to move within channel volume 40 these forces result in motion of voice coil 47 and diaphragm 25 with respect to support 30. The resilience of diaphragm periphery 28 permits substantial motion of diaphragm 25 thereby producing acoustic energy.

Due to the unique construction of the speaker set forth in FIG. 2A, the overall depth 21 indicated from apex 24 to first face 22 of backplate 45 is maintained at a substantially lesser depth than that found in conventional cone-type speaker constructions. A multiply-crimped annular spider sheet 52 is attached to hub 104 and to voice coil 47 by adhesive bonding and provides a dust cover protection for channel volume 40 and voice coil 47.

The improved loudspeaker shown in FIG. 2A using a one piece support 30 and the adaptively sized circular recess 37 and circular recess 100 to receive and centrally dispose the circular top plate 36 and ring magnet 40 produces an extremely compact speaker construction in which a maximum of diaphragm motion is obtained without excessive speaker depth.

FIG. 2B sets forth an alternate embodiment of the present invention speaker substantially similar in structure and operation to that shown in FIG. 2A in that a support 30 defines a mounting frame 33 and a hub 104 which receives and centrally locates a ring magnet 41 in top plate 36 having the same construction as that shown in FIG. 2A and defines a central aperture 53 which together with back plate 45 defines a channel volume 40. Also similar to the speaker construction of FIG. 2A diaphragm 25 is supported by a resilient diaphragm periphery 28 and defines a generally concave domes structure supporting a voice coil 47 a portion of which extends into channel volume 40. The primary difference between the embodiment shown in FIG. 2B from that in FIG. 2A is the provision of a rearwardly extending boss 33A surrounding mounting holes 34 and the greater depth between interior surface 32 of support 30 and mounting frame 33 of support 30 resulting in a coplanar allignment between the end of boss 34A and mounting frame 33. Further, an extension 34B extends rearward from the outer perimeter of mounting frame 33 and terminates in substantial alignment with the end of boss 34A. In further distinction, a pair of screws 103 are supported in support 30 rather than the binding posts 102 utilized in the embodiment of 2A. Screws 103 however receive the ends of wires 112 in a similar fashion to binding posts 102 and permit electrical connections to be made to coil winding 111.

The object of the structural differences of the embodiment in FIG. 2B is to produce a structure which facilitates mounting the present invention loudspeaker directly upon flat surfaces such as walls or cabinets without the use of a receiving cavity structure. This provides considerable advantage in economy in applications such as car doors, closet doors, desks and the like, in which spaces having limited volume and accessibility are used to accommodate speakers. In addition, the improved speaker of FIG. 2B may be installed or mounted in the same plane as other similarly structured to provide improved overall geometry of the speaker system.

In the embodiments of both FIGS. 2A and 2B, substantial advantage over prior art structures is achieved by the threaded fastening between top plate 36 and circular recess 37 and hub 104 in that the entire magnetic structure comprising top plate 36 ring magnet 41 back plate 45 and pole piece 39 is easily removeable. This ready removal of the magnetic structure provides considerable advantage in ease and speed of assembly as well as great flexibility due to its ability to receive interchangeable magnet structures having different characteristics. This permits the system designer to vary speaker performance in accordance with overall system parameters by simply changing the magnetic structure.

Referring to FIGS. 2A, 2B, and FIG. 3 together, the planar support component 30 can be a one piece aluminum casting or a high density molded plastic component, or stamped sheet metal. Support component 30 has a planar peripheral exterior mounting frame 33, multiple spokes 35 having triangular cross section as shown in FIG. 3A integrally secured to frame 33. Top plate 36 is integrally secured to each spoke 35. The cross section of the tubular voice coil 47 is also illustrated. Not more than the six equally angularly spaced mounting poles 34 are provided for securing the speaker 10 to an audio enclosure. No mounting frame gasket is required externally for the one piece planar support component 30.

A thin circularly crimped annular disc spider sheet 52 is bonded to the tubular voice coil 47 at sheet 52 inner periphery and to the bevelled edge 50 of top plate 36, using an adhesive such as epoxy cement (not shown). The crimped spider sheet 52 provides a dust cover for the speaker and is radially crimped to provide vibrational flexibility.

FIG. 4 is a frontal cross sectional view, as in FIG. 3, which illustrates another speaker modification 60 having ellipsoidal frontal geometry, the geometric shape being useful for special speaker mounting space requirements. The overall planar support component 61 has the same basic construction as component 30. There is a planar exterior mounting frame 62 with four mounting poles 63, eight radial spokes 64 integrally extending from frame 62.

The tubular voice coil 66 is shown in cross section. The eight spokes 64 have triangular cross sections, as in FIG. 3A, with a triangular apex 67 frontally extending.

FIG. 5 is another frontal cross sectional view, as in FIG. 3, of a circular loudspeaker 70, distinguished from loudspeaker 30 of FIG. 3. The distinguishing feature of speaker 70 is four larger cross section radial spokes 71, which can be sized for the desired rigidity. The spokes 71 are integrally secured to the mounting frame 72. A tubular voice coil 74 is shown in cross section.

Referring to FIG. 6, there is illustrated a phase coherent loudspeaker system 80, having a thin depth 81 of an enclosure 82. A higher frequency speaker 83 is shown, together with the low frequency speaker type represented by 10, 60, 70 and the like. Both speakers, 83 and 84, are shown disposed in and secured to enclosure 82 at front panel 85. The system 80 provides phase coherent audio signal, due to the in-phase coherence of the audio signal from speakers 83 and 84.

The loudspeaker system 80 is adaptively sized to be secured in restricted volumes, such as car doors, closet doors, desks, and other spaces of limited volumes, yet produce quality audio signals.

Conventional loudspeaker impair sound waves as the cones move up and down, the standing waves reflected off the frame component structure cause sound distortion. The speaker cones act as air pistons, pushing the air in response to electrical impulses applied to the voice coils. The cone response is not uniform unless the entire cone moves with the voice coil. The deep conventional speaker cone causes flex and breakup during the long cone excursions, resulting in sound distortion.

In contrast, the improved phase coherent loudspeaker of the present invention utilizes stiffer, less flexible diaphragm cone, creating a smoother frequency response. The voice coil of the present invention improved loudspeaker can be installed in the same plane of the loudspeaker enclosure as the higher frequency speakers, allowing all sound waves to reach the listener at the same time. The beveled edges of frame component tend to eliminate reflecting sound waves, and distortion.

The simplified production of parts and the low assembly manufacturing costs of the present invention speaker lead to lower overall cost of production. The frontal dimensions of the present invention improved speaker can be varied as required by design choice and application. As should be apparent, the improved phase coherent loudspeaker of the present invention is thinner than corresponding a conventional woofer such as speaker 11 of FIG. 1A. The improved phase coherent speaker of this invention is responsive to sound waves having frequencies of 20 to 5000 Hz, with particular responsiveness to the lower frequency range of 20 to 1000 Hz.

Planar frontal support components can have circular, ellipsoidal, square frontal geometry and the like.

Figure 7:
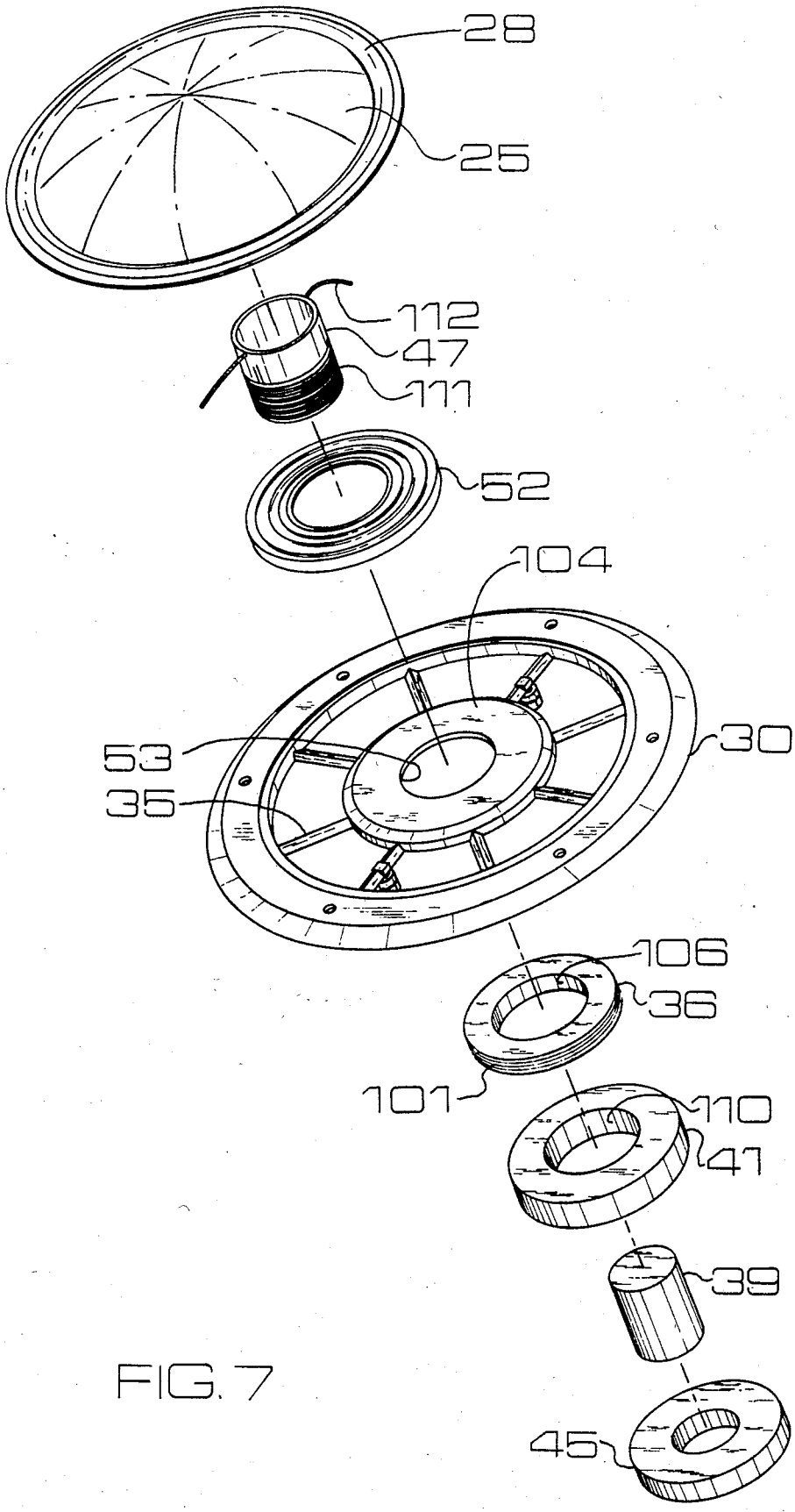
FIG. 7 is an exploded assembly view of a speaker constructed in accordance with the present invention.

FIG. 7 sets forth an exploded or assembly view of a speaker constructed in accordance with the present invention and having a structure similar to that set forth in FIG. 2A. As can be seen by examination of FIG. 7, a dome-shaped diaphragm 25 and diaphragm periphery 28 form a unitary structure which is assembled to voice coil 47 by adhesive bonding or similar teachnique producing a structure which is then inserted into the central aperture 53 of support 30. As mentioned, support 30 is constructed in accordance with the descriptions set forth in FIG. 2A, however, suffice it to note here that spokes 35 are of the triangular construction set forth in FIG. 3A and disposed such that the inclined surfaces thereof reduce acoustic interaction and reflections from the interior of diaphragm 25. Top plate 36 comprises an annular member which defines a plurality of exterior threads 101 which, as mentioned, are received within the underside of support 30 by circular recess 37 (not visible). Back plate 45 and pole piece 39 are adhesively bonded together and further bonded to ring magnet 41 and top plate 36 to produce the magnetic unit above described as being interchangeable. As can be seen in FIG. 7, once back plate 45 pole piece 39 magnet 41 and top plate 36 are bonded together, the assembly of their combined structure to support 30 is a simple matter of mating exterior threads 101 with the corresponding threads of circular aperture 37 and turning the structure until top plate 36 is fully received within circular recess 37.

Figure 8:
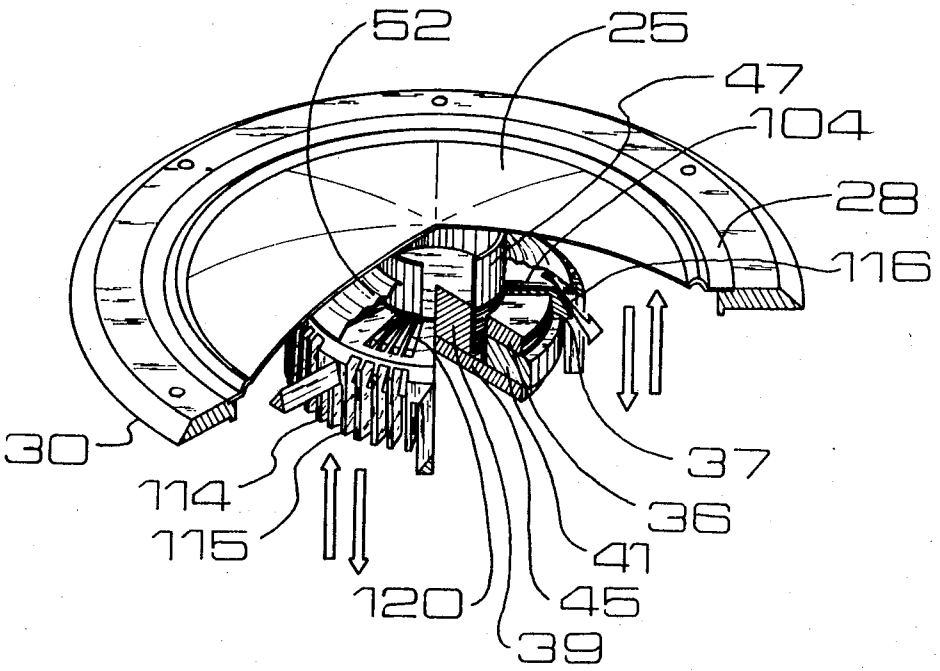
FIG. 8 is a partially sectioned perspective view of an embodiment of the present invention speaker having a diaphragm-driver cooling system.

FIG. 8 sets forth an alternate embodiment of the present invention speaker in which diaphragm 25 voice coil 47 spider sheet 52 hub 104 diaphragm periphery 28 are of substantially the same structure as that set forth in FIGS. 2A and 2B. Further, the magnet structure comprising back plate 45 pole piece 30 ring magnet 41 and top plate 36 are also of identical structure to that set forth in previous embodiments and in accordance therewith are received within circular recess 37 of hub 104 in an identical manner to that set forth in previous embodiments.

The substantial difference between the embodiment of FIG. 8 and that shown in previous figures is the modification of the structure to include a heatsink 114 which is of generally annular construction and is received by the overlies hub 104. Heatsink 114 defines a plurality of fins 115 which extend radially outward from hub 104. Heatsink 114 further defines a plurality of slots 120 radially disposed with respect to the center axis of the speaker structure and in general alignment with the spaces between fins 115. A plurality of channels 116 form passages through the body of heatsink 114 to couple slots 120 and the spaces between fins 115.

The structure of heatsink 114 permits the passage of air through slots 120, channels 116, and outward between fins 115. As known, the presence of high power electrical currents within an electrical winding such as winding 111 of voice coil 47 produces heat which often becomes damaging to the winding assembly. It is desirable in speaker structures to dissipate such heat to the extent possible. To meet this need, prior art structures often included motor driven cooling fans within speaker enclosures to produce such cooling. Such motor driven fans produce noise and are costly. However, the improved structure of the present invention embodiment set forth in FIG. 8 provides forced air cooling without any motor driven fans by using the free channel of air moving inward and outward from the magnet structure as diaphragm 25 is moved with respect to support 30. The motion of diaphragm 25 produces a mechanical push-pull action whereby substantial volumes of air are moved across the structure of heat sink 14 and fins 115 resulting in cooling of the speaker structure without the use of additional forced air systems. As a result, high electrical currents can be used in the voice coil winding assembly without increasing the impedence of the structure and reducing the power output of the speaker.

Figure 9B:
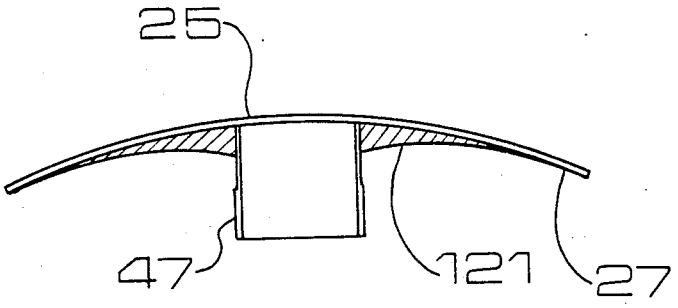
FIGS. 9A and 9B are respective section views of an alternate embodiment of a diaphragm for the present invention speaker.
Figure 9A:
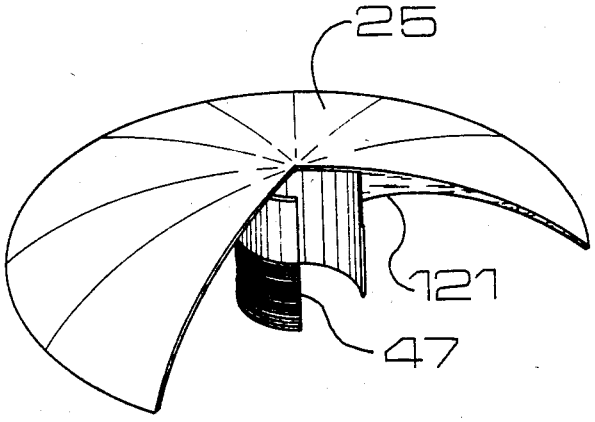

FIGS. 9A and 9B set forth an improved diaphragm structure in accordace with the present invention in which a unitary voice coil and diaphragm structure is provided with additional support by the use of diaphragm reinforcements. Specifically, and as shown jointly in FIGS. 9A and 9B, diaphragm 25 and voice coil 47 form a unitary structure substantially the same as that set forth in previous embodiments. The difference in the embodiment of FIGS. 9A and 9B however is the provision of additional diaphragm supports 121 upon second surface 27 of diaphragm 25 which extend substantial distances outward from voice coil 47. The extent of diaphragm support utilized is a matter to some extent of design choice. However, diaphragm supports 121 will in most applications be formed of a mechanically stable material and positioned with respect to diaphragm 25 to produce an optimum ratio of stiffness to weight in the resulting structure. The optimization of this ratio of stiffness to weight produces a proper acoustic response with maximum mechanical stability. The use of the reinforcements of diaphragm supports 121 prevents the occurrence of the phenomenon known as "cone breakup", caused by non-linear motion and undesirable harmonic distortion as diaphragm 25 moves under the influence of voice coil 47. In addition, the use of diaphragm supports 121 reduces the phenomenon known as "edge resonance" in which the mechanical resonance of diaphragm 25 as an acoustic resonator becomes a factor in speaker performance.

Figure 10A:
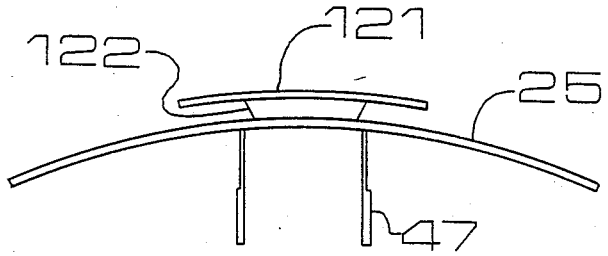
FIGS. 10A through 10D are simplified section views of alternate embodiments of diaphragm for the present invention speaker.

FIGS. 10A through 10D show simplified cross sectional views of alternate embodiments of diaphragm 25 all of which utilize the integral structure of diaphragm 25 and voice coil 47 and all are interchangeable with diaphragm 25 in the preceding embodiments. However, the structure set forth in FIGS. 10A through 10D differ in the inclusion of various refinements of diaphragm construction. FIG. 10A sets forth a secondary diaphragm 121 having a generally smaller surface area than that of diaphragm 25 and being attached to the center portion of diaphragm 25 by a rigid support 122. The function of secondary diaphragm 121 is to provide an effective high frequency response while still being driven by the same voice coil 47 as diaphragm 45.

Figure 10B:
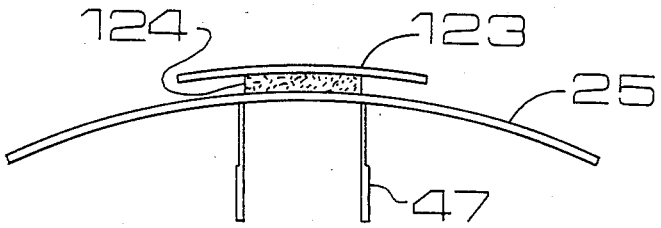

FIG. 10B sets forth a similar embodiment to that of FIG. 10A with the variation that rather than the rigid support 122 shown in FIG. 10A a resilient support 124 is used to attach secondary diaphragm 123 to the apex of diaphragm 25. The advantage of using resilient support 124 is to reduce the interaction between secondary diaphragm 123 and diaphragm 25 by providing vibrational acoustic dampening to reduce acoustic energy coupled between secondary diaphragm 123 and diaphragm 25 particularly that acoustic energy which emerges from the back of secondary diaphragm 123. As a result, the possibility of mechanical intermodulation between the two diaphragms is reduced.

Figure 10C:
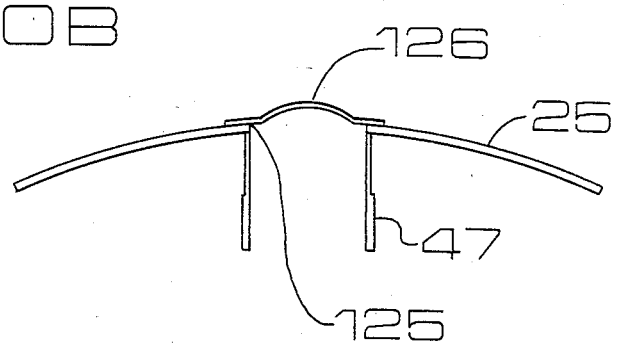
Figure 10D:
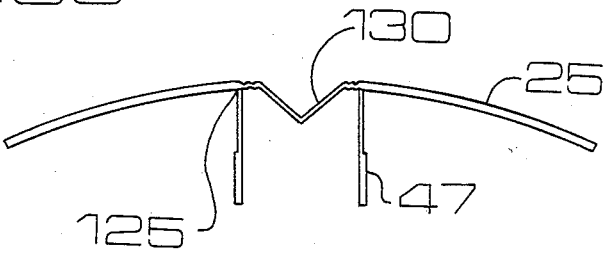

FIGS. 10C and 10D provide central structures which act to control the pattern of acoustic energy produced by the motion of diaphragm 25. It should be generally noted that the domed structure of diaphragm 25 in all of the present invention embodiments produces a substantially improved more uniform radiation pattern of acoustic energy than conventional cone structures which tend to concentrate the high frequencies along the center axis of the speaker and thereby cause a loss of fidelity for listeners not aligned along the speaker axis. In contrast, the domed structure of the present invention diaphragm 25 tends to produce a more uniform pattern of radiation due to its hemispherical construction which in turn results in improved phase coherency. Within the general improvement of the hemispherical structure of diaphragm 25 however, the embodiments of FIGS. 10C and 10D provide center structures which permit the alteration of this radiation pattern. FIG. 10C for example, provides a diaphragm aperture 125 in the center of diaphragm 25. A center dome 126 having a smaller radius of curvature than diaphragm 25 is bonded to the perimeter of diaphragm aperture 125 to produce a convex center structure which as mentioned alters the acoustic radiation pattern of diaphragm 25. Conversely, the embodiment shown in FIG. 10D provides a concave structure 130 which extends inwardly into voice coil 47 and is bonded to diaphragm aperture 125.

As would be expected, the radiation pattern produced by center well 130 differs substantially from that produced by center dome 126. It is important note in examination of FIGS. 10A through 10D that the utilization of the appropriate combination of center structures, provides substantial flexibility in tuning or refining the total system response of speaker systems using the present invention speaker structure.

Figure 11:
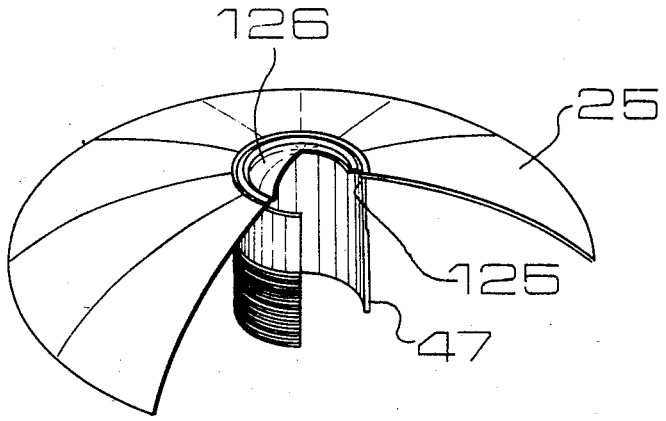
FIG. 11 is a partially sectioned perspective view of the diaphragm embodiment of FIG. 10C.

FIG. 11 sets forth a perspective view of the embodiment of diaphragm 25 shown in FIG. 10C. As can be seen, diaphragm 25 is bonded to voice coil 47 in accordance with the embodiments set forth above. In addition, diaphragm aperture 125 is centrally located with respect to diaphragm 25. Further, center dome 126 is bonded to diaphragm 25 and overlies diaphragm aperture 125.

Figure 12:
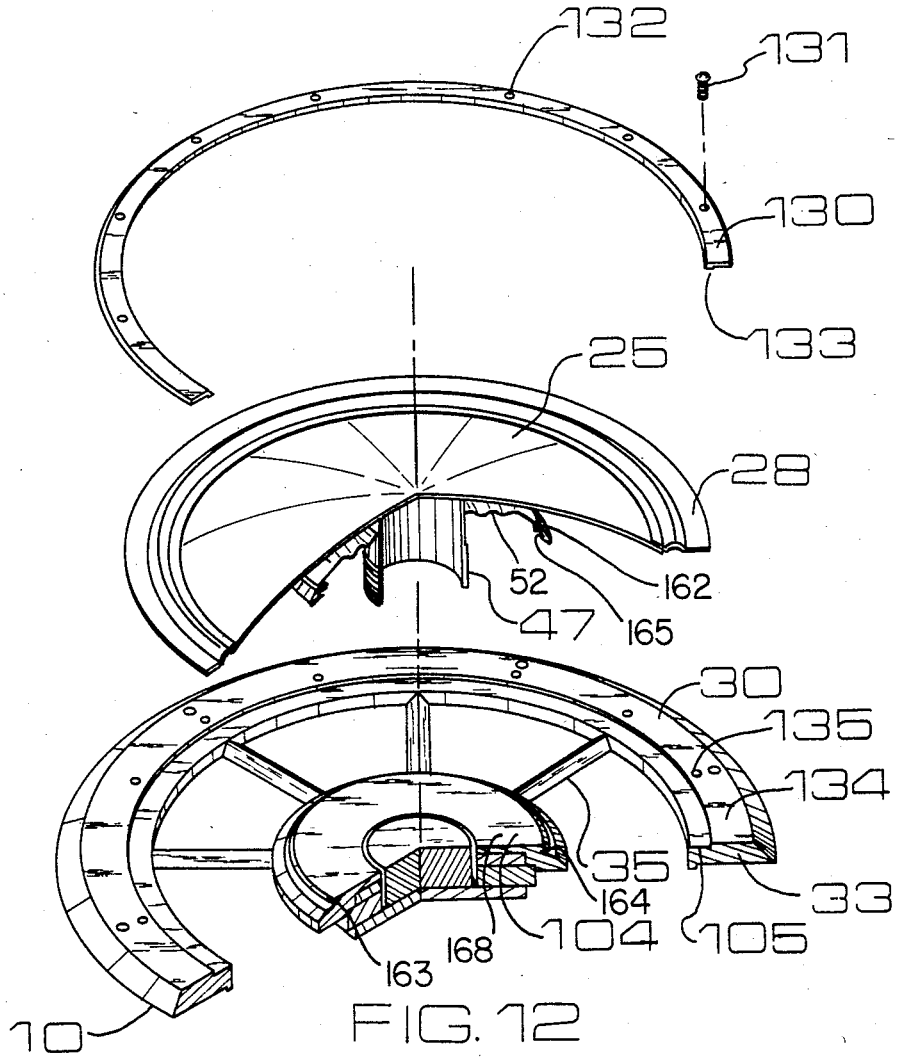
FIG. 12 is a partially sectioned perspective assembly view of a portion of the removeable diaphragm and support therefore of the present invention speaker.
Figure 12A:
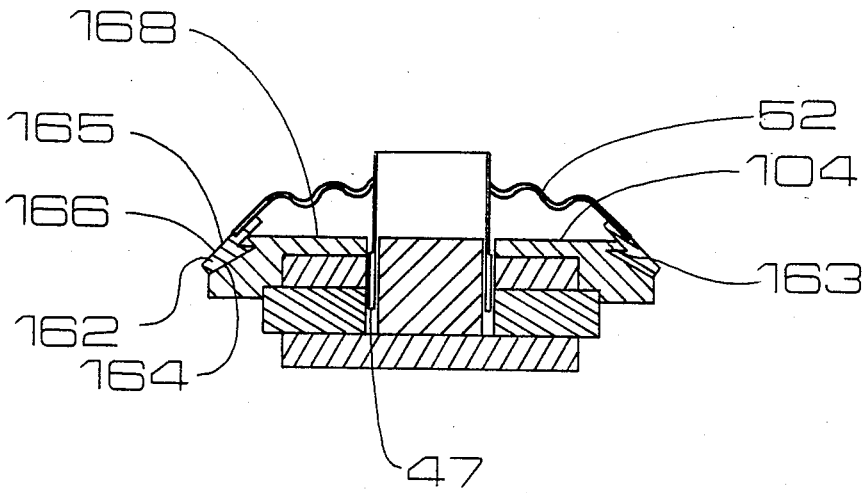
FIG. 12A is a section view of the magnet and voice coil assembly of the present invention speaker.
Figure 12B:
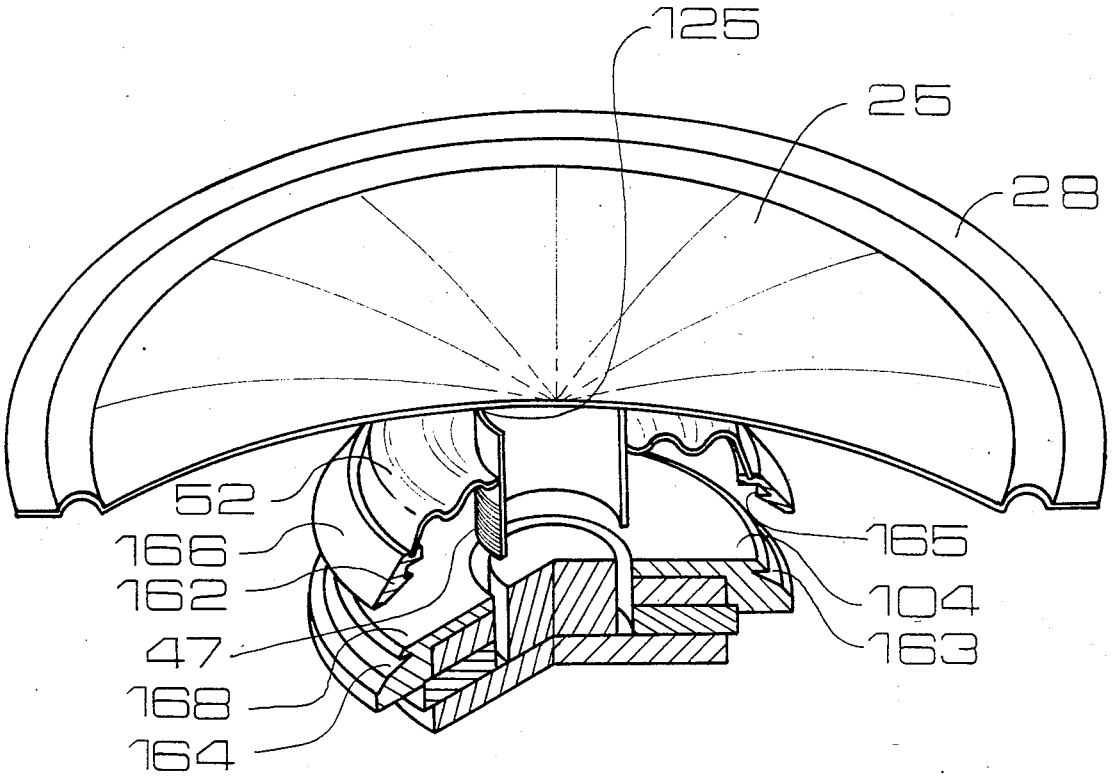
FIG. 12B is a partial section view of the embodiment of the present invention speaker shown in FIG. 12.

FIG. 12 sets forth a partially sectioned exploded view of a portion of an alternate embodiment of the present invention in which there is provided the capability to remove diaphragm 25 from the speaker permitting interchange of diaphragm structures or replacement of damaged or defective diaphragms. Support 30 is constructed substantially in accordance with the annular support used in previous embodiments and in accordance with previous embodiments defines a center hub 104 and a mounting frame 33 coupled by a plurality of radially extending spokes 35. The magnet structure is substantially the same as that set forth in prior embodiments. In addition, center hub 104 defines a first hub surface 164 inclined to the plane of support 30 and a second hub surface 168 substantially parallel to the plane of support 30. Hub 104 further defines an outwardly extending hub lip 163 which as set forth below cooperates with snap ring 162 to secure spider 52. Diaphragm 25 includes a resilient diaphragm periphery 28 constructed in accordance with embodiment set forth above and a spider sheet 52 as well as a voice coil 47. Diaphragm periphery 28 fits within and is accommodated by diaphragm recess 105 when diaphragm 25 is assembled within speaker 10. An annular substantially flat diaphragm ring 130 is sized to overlie the portion of diaphragm periphery received by diaphragm recess 105 and to rest upon surface 134. Diaphragm ring 130 further defines a downwardly extending rim 133. When diaphragm ring 130 is mated to surface 134 and diaphragm periphery 28 and secured by fasteners through aperture 132 of diaphragm ring 130 and apertures 135 of support 30, a gripping force is produced maintaining diaphragm periphery 28 within diaphragm recess 105. In other words, rim 133 of diaphragm ring 130 and diaphragm recess 105 captivate diaphragm periphery 28 in the assembled structure and maintain support diaphragm 25 in a resilient manner.

Spider 52 is bonded to voice coil 47 beneath diaphragm 25 and to a snap ring 162, snap ring 162 is an annular plastic member having a snap ring surface 166 and an internal snap ring groove 165. While any number of plastic or similar materials maybe used to fabricate snap ring 162, it has been found advantageous to use an elastic type material for reasons set forth below.

Accordingly, spider 52 and snap ring 162 are supported by voice coil 47 and diaphragm 25 when the latter is removed from support 30.

In accordance with an important aspect of the present invention, snap ring 162 may be readily assembled to nub 104 of support 30 by pressing snap ring surface 166 downward against hub lip 163 (FIG. 2A) until snap ring 162 expands permitting hub lip 163 to nest into snap ring groove 165. Once assembled the resilience of snap ring 162 maintains hub lip 163 within snap ring groove 165. Removal is accomplished by lifting snap ring 166 away from first hub surface 164 and pulling snap ring groove 165 away from hub lip 163.

Because diaphragm 25 may be assembled to support 30 by fasteners 131 and diaphragm ring 130 and because snap ring 162 may be snapped to hub 104, the completion of assembly required to install diaphragm 25 within speaker 10 is greatly simplified. The present invention structure shown in FIG. 12 further provides the advantage of easy removal of diaphragm 25 from speaker 10. The entire diaphragm and voice coil assembly may be removed by simply removing fasteners 131 from diaphragm ring 130 and unsnapping snap ring 162 thereafter diaphragm ring 130 is removed from surface 134 and diaphragm 25 may be drawn outwardly from speaker 10. It will be apparent to those skilled in the art that this easy removal of diaphragm 25 from the front side of speaker 10 presents considerable advantages in diaphragm replacement and interchange. This is particularly true once speaker 10 has been installed in wall mount or cabinet configurations. Unlike prior art structures which require removal of the entire speaker asembly from the speaker housing or cabinet to change diaphragms, the structure in FIG. 12 permits exchange of diaphragm 25 while speaker 10 remains mounted.

Figure 13:
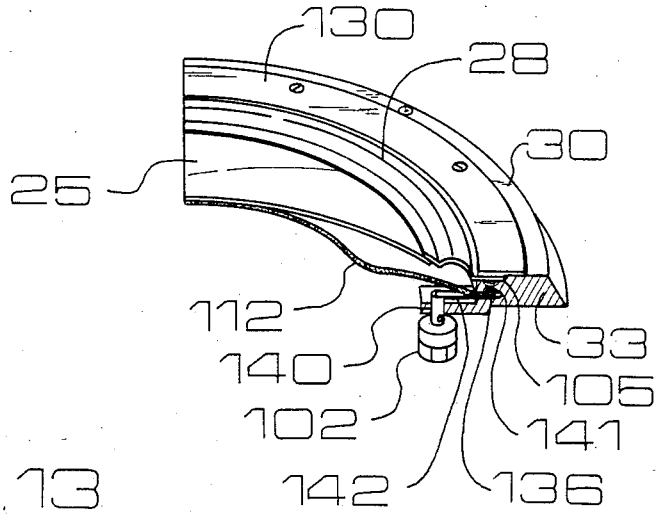
FIG. 13 is a sectioned detail drawing of an alternate embodiment of the binding post of the present invention speaker.

FIG. 13 sets forth an alternate embodiment for providing electrical connections to voice coil winding 111 whereby binding post 102 is supported within mounting frame 33 by an aperture 140 therein. Mounting frame 33 further defines an outwardly extending wire recess 136 within which a spring 141 is captivated. A conductive element 142 extends from the interior of wire recess 136 to binding post 102. In operation, voice coil wire 112 having its insulation removed from the end portion thereof is inserted into wire recess 136. In accordance with well known fabrication techniques, captivated spring on screws 141 grips the inserted end of coil wire 112 within recess 136 forcing it against conductor 142 to maintain an electrical connection. The advantage of the structure shown in FIG. 13 is to provide a simplified assembly in which the advantage of a removable diaphragm such as that shown in FIG. 12 may be utilized to its fullest in that the coil wires 112 of voice coil 147 of the diaphragm assembly may be connected to binding posts 102 (and thereby the rest of the speaker system) from the front postion of speaker 10 during diaphragm installation.

Figure 14B:
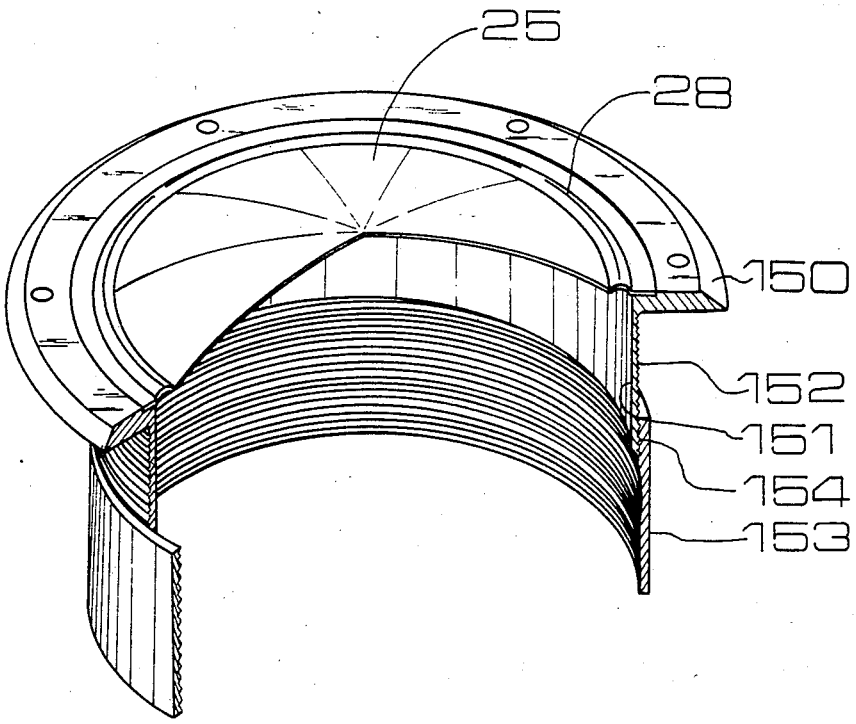
FIGS. 14A and 14B are partially sectioned perspective views of resonators constructed in accordance with the present invention.
Figure 14A:
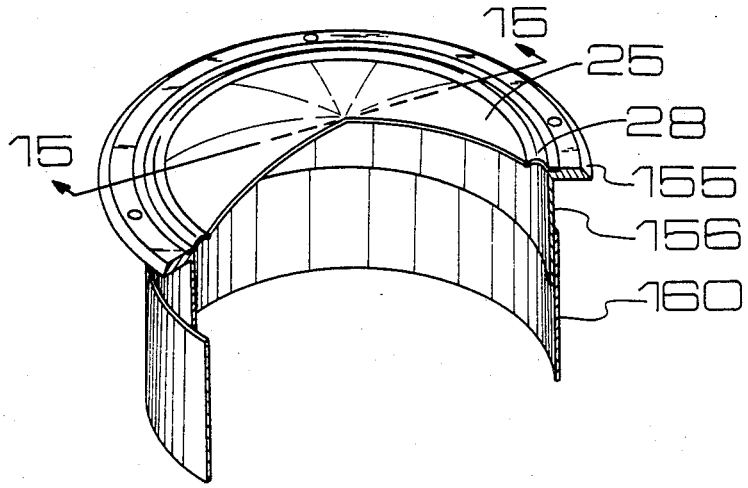
Figure 14A:
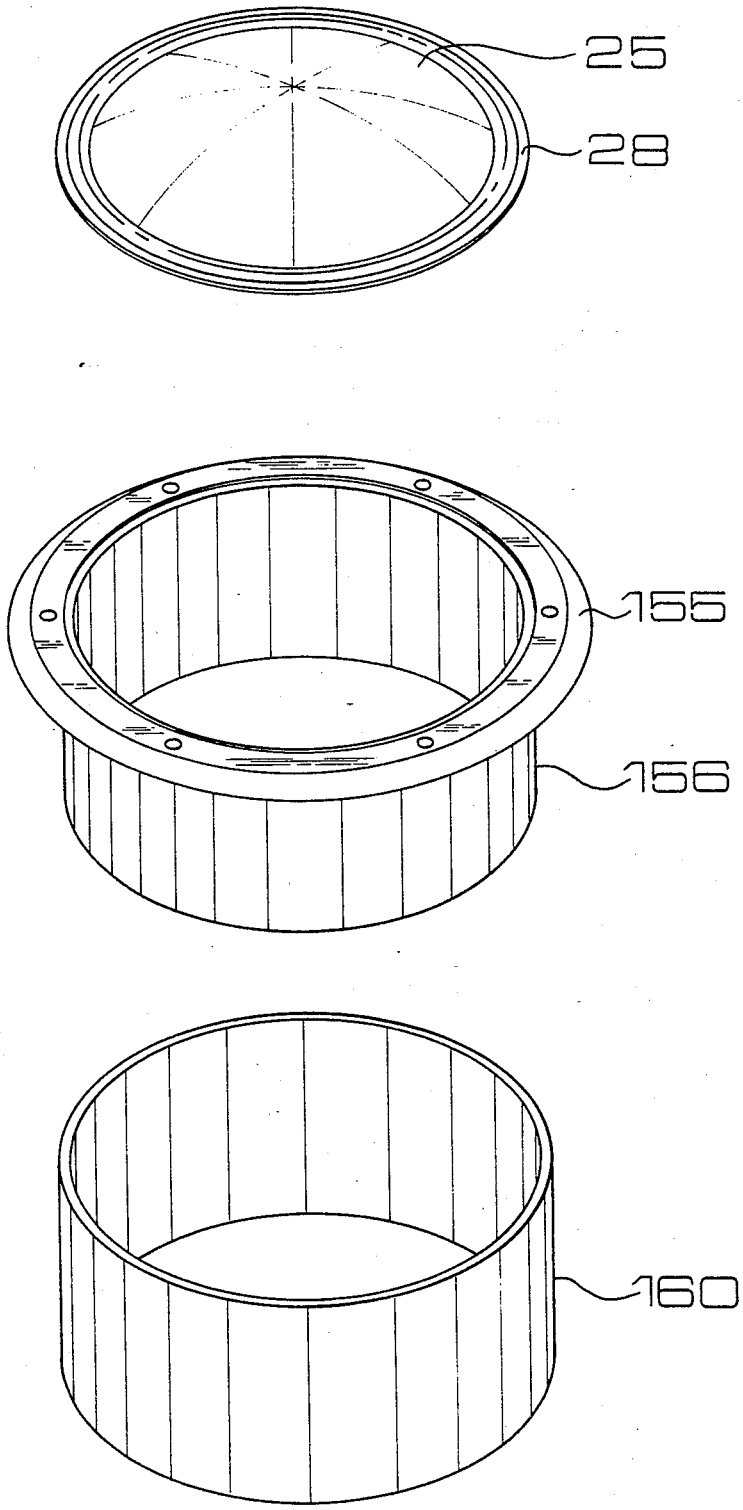
Figure 14B:
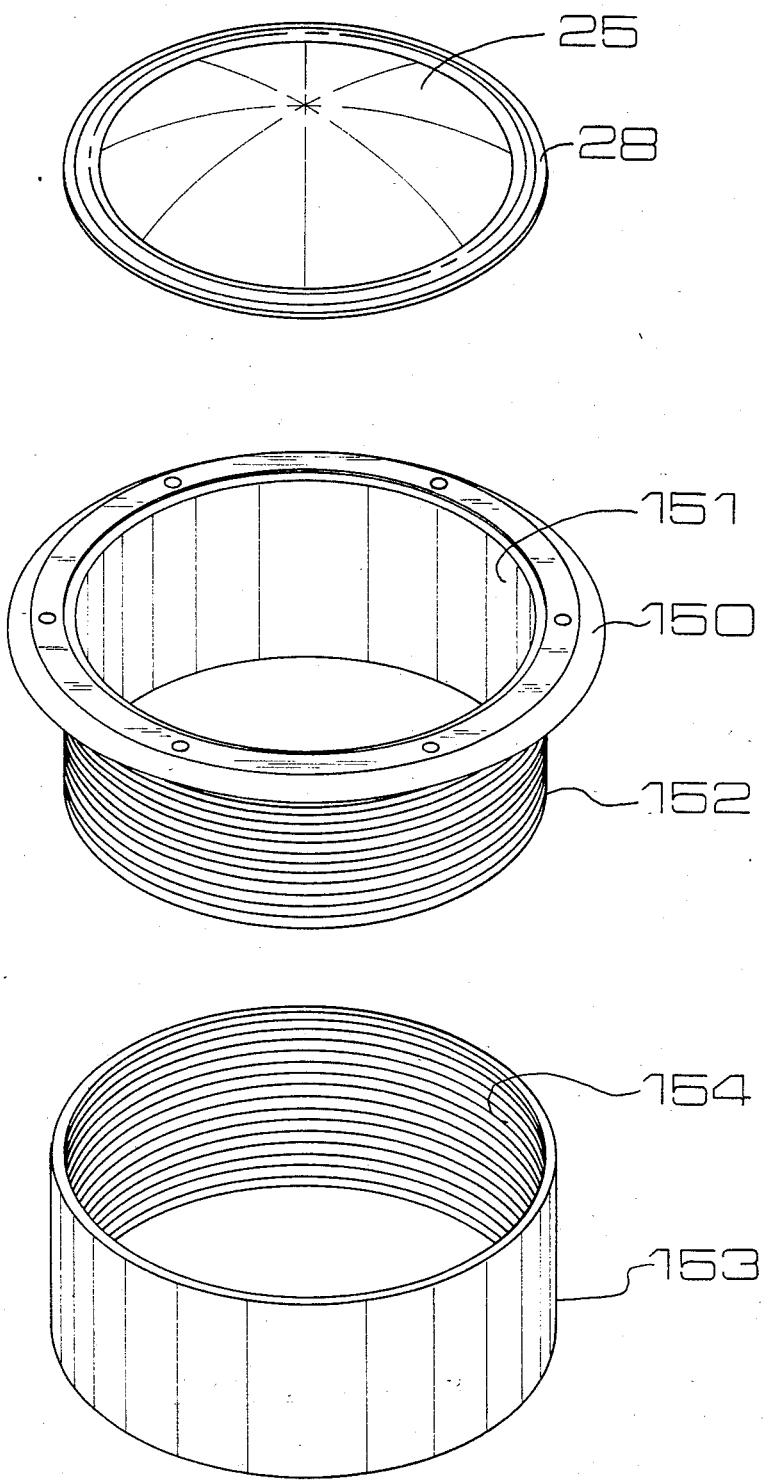
Figure 15:
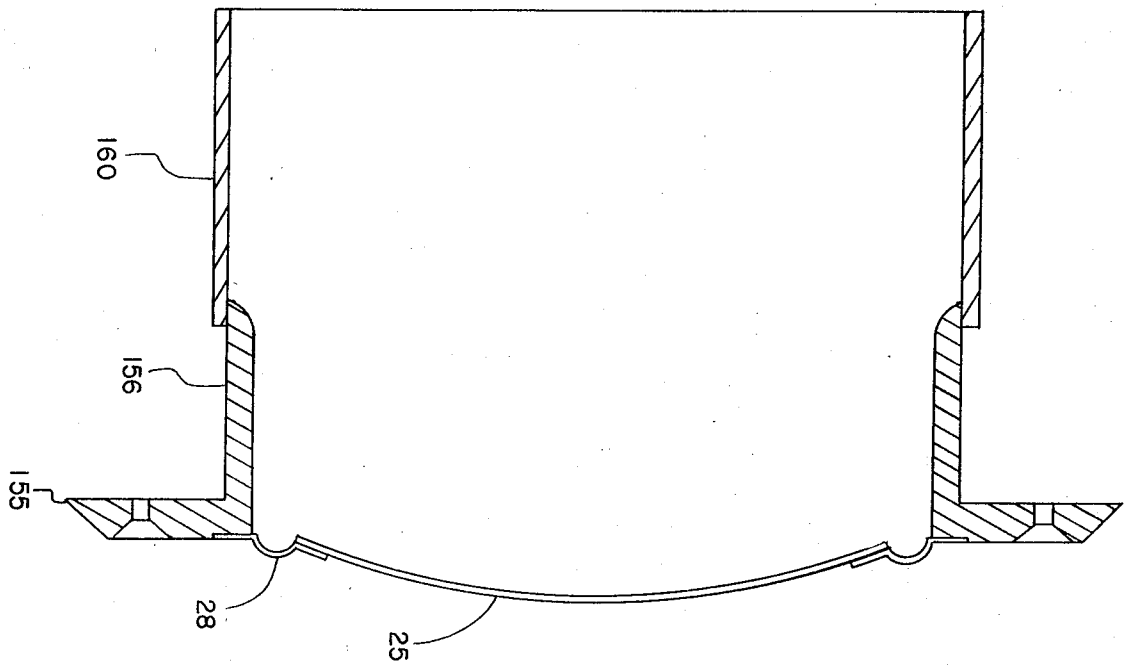
FIG. 15 is an elevational side view of resonators in FIG. 14A.

FIGS. 14A and 14B set forth an improved speaker system component constructed in accordance with the present invention in which there is provided an acoustic resonator compatible both physically and acoustically with the present invention speaker system. The resonator has a reduced overall depth and the further advantage in which the extention of the resonant acoustic part then may be varied, the latter alters the acoustic performance of the resonator specifically and with reference to FIG. 14A, a tunable resonator is shown which utilizes diaphragm 25 constructed in accordance with the foregoing speaker embodiments. In addition, a support 155 which comprises a generally annular member having an exterior appearance substantially similar to support 30 of the above-described speaker embodiments. In further similarity to the above described speaker embodiments, diaphragm periphery 28 of diaphragm 25 is bonded to support 155 in the same manner as that set forth in support 30 of the embodiment shown in FIG. 2A. Support 155 further defines a cylindrical tube 156 extending from diaphragm 25 and a receiving tube 160 having a cylindrical structure in which the interior dimension of tube 160 is sized to receive tube 156 in a snug or interference type fit. As a result, the position of tube 160 upon tube 156 is maintained once its distance from diaphragm 25 is set by the friction between tubes 156 and 160.

A similar structure for the present invention resonator is set forth in FIG. 14B in which diaphragm 25 periphery 28 are again identical to those set forth in conjunction with the above-described speaker systems. A support 150 is substantially identical to support 155 of FIG. 14A with the exception that it defines a tube 151 similar to tube 156 with the exception of an external thread 152. A second tube 153 which is similar to tube 160 in the embodiment of FIG. 14A is distinguished therefrom however by an internal thread 154. Threads 152 and 154 are cooperative and permit tube 153 to be screwed onto tube 152. The distance or length of the resulting combination of tubes 152 and 153 is adjusted by turning tube 153 with respect to support 150.

The depth of the tube port for the acoustic resonator shown in FIGS. 14A and 14B is physically adjustable by moving the most remote tube with respect to the support. The result is to vary the effective tube length underlying diaphragm 25 to approximate an infinite pneumatic hyperbolical resonator that can be installed in the same cabinet configurations of the present invention loudspeaker above described. The resonator shown has the same advantages of reduced overall size and minimum cabinet depth requirements as the above described speakers. In addition, because the resonators shown are adjustable, not withstanding their substantially reduced depths, they may be utilized in combination and are compatible with the above-described speaker assemblies. This provides an overall combination speaker and resonator structure which has the synergistic benefit of compatible structure and acoustic interaction to permit tuning or adjusting of the combined response of the present invention speaker and the present invention resonator such that the characteristics of the speaker may be compensated for by the resonator. While any number of compensations are achievable, one of the more advantageous compensations results from the ability of the combined structure to overcome what is otherwise a deleterious effect in speaker systems often referred to as "speaker aging". Because of the gradual loosening of the suspension of speaker systems with repeated use, a shift in the resonance charateristics of the speaker results and the speaker "ages" In the absence of the present invention resonator, such shifts in speaker resonance and characteristics with aging would result in an alteration of the system performance form that optimally designed and originally manufactured. However, as will be apparent to those skilled in the art, the present invention resonator may be adjusted in order to compensate for and to a great extent overcome this otherwise degrading effect in system performance.

Figure 16:
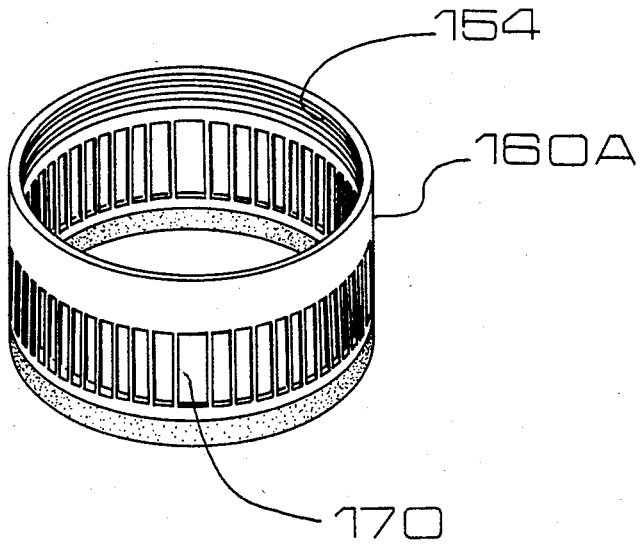
FIG. 16 is a tubular section for receiving either resonators of FIG. 14A or 15 and woofer, as shown in FIG. 2B.
Figure 17:
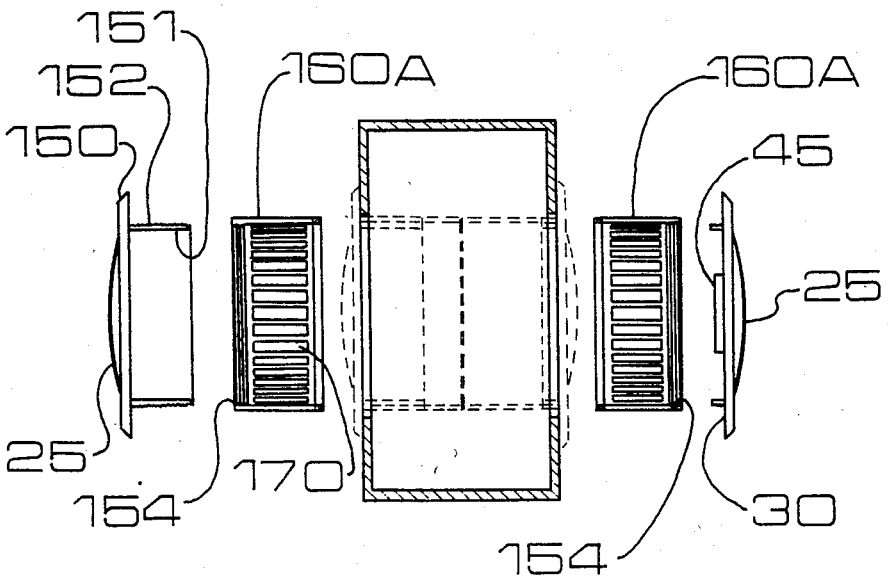
FIG. 17 is an elevational side view of speaker cabinet with dual tubular sections supportive of the woofers.
Figure 18:
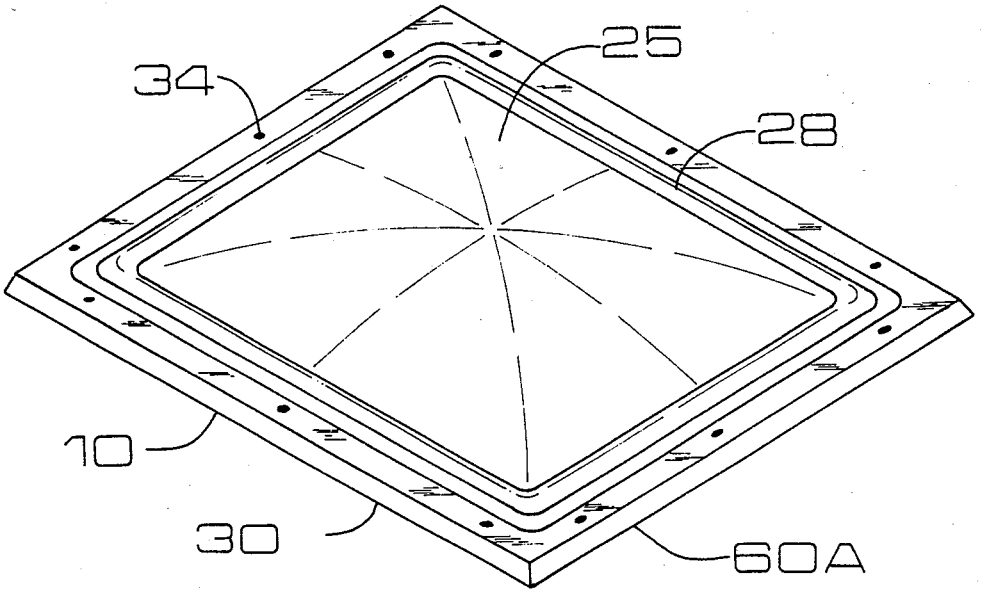
FIG. 18 is a square geometric shape of the mounting frame, as described herein.

FIGS. 16 and 17 set forth tubular sections 160A provided with ribs 170 extending axially with and between the upper and lower rims thereof. The purpose of tubular sections 160A is to support mounting frame 30 of speaker 10 and also mounting frame 150. As illustrated in FIG. 17 a combination of two tubular sections 160A are interlockingly mounted by way of threaded screw connections 154, pressure fitted insertable within the speaker cabinet (as shown by dotted lines) for the additional purpose of increasing the stability of the cabinet. It should also be noted that from one single support system (the basket of the prior art) combinations of varieties of speakers may be utilized to build any desired specific combination thereof.

What has been shown is a compact, extremely shallow loudspeaker structure and accompanying resonator which facilitates ease of assembly and quality audio production together with flexibility in applications and achieves substantial advantage over prior art cone speaker structures. While particular embodiments of the present invention have been set forth and explanations thereof have been extensive, the extent of such descriptions is to be illustrative of the present invention rather than limiting. The invention is set forth in its true scope in the appended claims.

I claim:

1. An improved loudspeaker construction combination comprising:

a one piece planar support component, having a top plate and an exterior first face, an interior second face, and having an exterior planar peripheral frame having regular geometry frontal dimensions, said frame having not more than eight mounting holes regularly disposed through said frame, said frame having an inner and outer edge, multiple spokes extending radially inwardly from said peripheral frame at uniform angular positions, said multiple spokes being less than nine in number, said multiple spokes integrally secured to said peripheral frame, each said multiple spoke having triangular cross section with one apex of each cross section facing said support components first face, a circular hub integrally secured to said multiple spokes angularly converging on said top plate, said hub having an exterior hub bevel edge adjacent said multiple integral spokes, said hub having a central circular aperture disposed therethrough, said hub having an adaptively sized circular recess centrally disposed in the second face of said hub, a planar back plate adaptively size and having a first planar face and a second planar face, a circular permanent planar ring magnet having first and second planar faces, said first face of said magnet bonded to said first face of said back plate by a permanent bonding agent, a pole piece adaptively sized and concentrically fitting into the inner ring of said ring magnet, permanently bonded by a bonding agent on the pole piece first face to said first face of said back plate, providing a concentric annular free channel volume between said pole piece and said ring magnet, aforesaid planar back plate and bonded ring magnet and bonded pole piece are adaptively permanently bonded onto the second face of said top plate a convex shallow depth cone diaphragm having a peripheral edge bonded by a permanent cement to said inner edge of said peripheral frame, said convex cone diaphragm having a central exterior cone apex, a first exterior face and a second interior face, and, a tubular thin voice coil having a voice coil first terminus secured by a permanent bonding to the interior second face of said diaphragm, said thin voice coil being concentrically disposed and secured in said face channel volume, providing audio vibrational excursions of said bonded coil and diaphragm on receiving electrical signals in said voice coil, said loud speaker construction providing a phase coherent audio signal.

2. An improved loudspeaker as set forth in claim 1 wherein said voice coil of said loudspeaker is disposed in the plane of said enclosure frontal plane, said loudspeaker further including:

a speaker enclosure having a thin depth, and having an adaptively sized frontal area plane, and at least one higher frequency loudspeaker having a frequency higher than said low frequency speaker, the voice coil of said higher frequency loudspeaker disposed in the plane of said enclosure frontal plane.

3. An improved loudspeaker construction combination comprising:

a one piece planar support component, having an exterior first face and an interior second face, and an exterior planar peripheral frame having regular geometry frontal dimensions, said frame having not more than eight mounting holes regularly disposed through said frame, said frame having an inner and outer edge, multiple spokes extending radially inwardly from said peripheral frame at uniform angular positions, said multiple spokes being less than nine in number, said multiple spokes integrally secured to said peripheral frame, each said multiple spoke having triangular cross section with one apex of each cross section facing said support component first face, a circular hub integrally secured to said multiple spokes angularly converging on said hub, said hub having an exterior hub bevel edge adjacent said multiple integral spokes, said hub having a central circular aperture disposed therethrough, said hub having an adaptively sized circular recess centrally disposed in the second face of said hub, a planar back plate adaptively sized and having a first planar face and a second planar face, a circular permanent planar ring magnet having first and second planar faces, said first face of said magnet bonded to said first face of said back plate by a permanent bonding agent, a pole piece adaptively sized and concentrically fitting into the inner ring of said ring magnet, permanently bonded by a bonding agent on the pole piece first face to said first face of said back plate, providing a concentric annular free channel volume between said pole piece and said ring magnet, aforesaid planar back plate and bonded ring maggnet and bonded pole piece are adaptively permanently bonded into the second face of said hub, a convex shallow depth cone diaphragm having a peripheral edge bonded by a permanent cement to said inner edge of said peripheral frame, said convex cone diaphragm having a central exterior cone apex, a first exterior face, and a second interior face, a tubular thin voice coil having a voice coil first terminus secured by a permanent bonding to the interior second face of said diaphragm, said thin voice coil being concentrically disposed and secured in said free channel volume, providing audio vibrational excursions of said bonded coil and diaphragm on receiving electrical signals in said voice coil, and, a thin circularly crimped annular disc spider sheet having an inner periphery and an outer periphery, said inner periphery being permanently bonded circularly to said voice coil, and said outer periphery being permanently bonded circularly to said beveled edge of said hub.

said loud speaker construction providing a phase coherent audio signal.

4. An improved loudspeaker construction combination comprising:

a one piece planar support component, having an exterior first face and an interior second face, and an exterior planar peripheral frame having regular geometry frontal dimensions, said frame having not more than eight mounting holes regularly disposed through said frame, said frame having an inner and outer edge, multiple spokes extending radially inwardly from said peripheral frame at uniform angular positions, said multiple spokes being less than nine in number, said multiple spokes integrally secured to said peripheral frame, each of said multiple spokes having triangular cross sections with one apex of each cross section facing said support component first face, a circular hub integrally secured to said multiple spokes angularly converging on said hub, said hub defining a central circular recess and having an exterior hub bevel edge adjacent said multiple integral spokes, said hub having a central circular aperture disposed therethrough, said hub having an adaptively sized circular recess, centrally disposed in the second face of said hub, an annular top plate disposed within said circular recess, a planar back plate adaptively sized and having a first planar face and a second planar face, a circular permanent planar ring magnet having first and second planar faces, said first face of said magnet bonded to said first face of said back plate by a permanent bonding agent, a pole piece adaptively sized and concentrically fitting into the inner ring of said ring magnet, permanently bonded by a bonding agent on the pole piece first face to said first face of said back plate, providing a concentric annular free channel volume between said pole piece and said ring magnet, said planar back plate and bonded ring magnet and bonded pole piece are adaptively permanently bonded into the second face of said top plate, a convex shallow depth cone diaphragm having a peripheral edge bonded by a permanent cement to said inner edge of said peripheral frame, said convex cone diaphragm having a central exterior cone apex, a first exterior face and a second interior face, a tubular thin voice coil having a voice coil first terminus secured by a permanent bonding to the interior second face of said diaphragm, said thin voice coil being concentrically disposed and secured in said free channel volume, providing audio vibrational excursions of said bonded coil and diaphragm on receiving electrical signals in said voice coil, and a thin circularly crimped annular disc spider sheet having an inner periphery and an outer periphery, said inner periphery being permanently bonded circularly to said voice coil, and said outer periphery being permanently bonded circularly to said beveled edge of said hub, said loud speaker construction having depth magnitude from said first face of said back plate to said cone diaphragm apex of approximately one and one-half inches, said loudspeaker construction providing a phase coherent audio signals.

5. In a phase coherent loudspeaker set forth in claim 4, wherein, the exterior planar frame has a beveled outer edge.

6. An improved loudspeaker comprising:

a rigid substantially planar support member having an interior hub portion, an annular frame portion spaced apart from said hub portion, and a pluarality of radially extending spokes coupling said hub portion and said annular frame portion, said hub portion further defining a center aperture and a concentric recess;

a magnetic assembly having a cylindrical central pole piece having an outer diameter smaller than that of said center aperture, and an annular ring magnet concentrically disposed about a portion of said pole piece having an inner diameter greater than said outer diameter of said pole piece;

a volume chamber formed by the space between said pole piece and said ring magnet;

a voice coil assembly having a cylindrical insulative tube and a conductive electric winding wound upon said insulative tube;

a generally dome-shaped first diaphragm having a convex exterior surface and a concave interior surface;

means attaching said voice coil insulative tube to said concave interior surface of said first diaphragm; and means resiliently supporting said first diaphragm from said annular frame portion of said support member such that said convex exterior surface faces outwardly from said support member and said voice coil assembly extends into said volume chamber.

7. An improved loudspeaker as set forth in claim 6 wherein said means resiliently supporting said first diaphragm include an annular resilient member having a first surface portion attached to said first diaphragm and a second surface portion attached to said annular frame portion.

8. An improved loudspeaker as set forth in claim 7 wherein said annular frame portion defines a first recess and wherein said second surface portion of said annular resilient member is received within said first recess.

9. A improved loudspeaker as set forth in claim 8 wherein said annular resilient member is adhesively bonded to said first diaphragm.

10. An improved loudspeaker as set forth in claim 9 wherein said annular resilient member is adhesively bonded to said first recess.

11. An improved loudspeaker as set forth in claim 9 further including an annular diaphragm ring and means securing said annular diaphragm ring to said annular frame portion such that a portion of said annular resilient member is secured within said first recess without adhesive bonding.

12. An improved loudspeaker as set forth in claim 6 wherein said magnetic assembly further includes an annular top plate and an annular back plate and wherein said pole piece is adhesively bonded to said back plate and said annular ring magnet and said top plate are respectively bonded to said back plate, such that said back plate, said annular ring magnet, and said top plate are concentrically arranged with respect to said pole piece.

13. An improved loudspeaker as set forth in claim 12 wherein said concentric recess and said top plate each define cooperative threaded portions and wherein said magnetic assembly is supported entirely by the cooperation of said cooperative threaded portions.

14. An improved loudspeaker as set forth in claim 6 further including a generally toroidal heatsink disposed about and supported by said hub portion.

15. A improved loudspeaker as set forth in claim 14 wherein said heatsink defines first and second surfaces and a plurality of cooling fins extending radially from said first surface and a plurality of cooling passages, said cooling passages extending from the regions between said cooling fins to said second surface of said heatsink.

16. An improved loudspeaker as set forth in claim 6 wherein said first diaphragm includes a plurality of reinforcing members attached to said insulative tube and to said concave surface of said first diaphragm.

17. An improved loudspeaker as set forth in claim 6 wherein said first diaphragm further includes a second diaphragm smaller than said first diaphragm and means supporting said second diaphragm in a spaced relationship with said convex surface of said first diaphragm.

18. An improved loudspeaker as set forth in claim 17 wherein said means supporting said second diaphragm comprise a resilient acoustic dampening material.

19. An improved loudspeaker as set forth in claim 6 further including an adjustable acoustic resonator for modifying the acoustic characteristics of said improved loud speaker, said adjustable acoustic resonator including:

a second diaphragm having a generally domed-shape;

an annular support flange;

a resilient ring coupling said second diaphragm to said annular support flange such that said second diaphragm is moveable with respect to said annular support flange; and an adjustable length acoustic tube coupled to said annular support flange providing a variable acoustic tuning element whereby the acoustic resonance of said resonator may be varied by adjusting the length of said acoustic tube.

20. An improved loud speaker as set forth in claim 19 wherein said adjustable length acoustic tube includes a first cylinder coupled directly to said annular support flange; and a second cylinder sized to fit securely within said first cylinder, whereby the effective length of the combination of said first and second cylinders is varied by sliding said second cylinder with respect to said first cylinder.

21. An improved loudspeaker as set forth in claim 19 wherein said adjustable length acoustic tube includes: a first cylinder coupled directly to said annular support flange and defining an external threaded portion and a second cylinder sized to fit within first cylinder and defining an internal threaded portion having a thread compatible with and received by said external threaded portion, whereby the effective length of the combination of said first and second cylinders is varied by turning said second cylinder with respect to said first cylinder.

22. An improved loudspeaker as set forth in claim 11 wherein said interior hub portion defines an outwardly extending lip and wherein said improved loud speaker further includes a resilient dust cover coupled to and extending outwardly from said insulative tube of said voice coil; and means for removably attaching said resilient dust cover to said outwardly extending lip of said interior hub.

23. An improved loudspeaker as set forth in claim 22 wherein said means for removably attaching include an annular ring of elastic material bonded to said resilient dust cover and defining an internal groove for receiving said extending lip when said annular ring of elastic material is forced against said internal hub.

* * * * *